US008967159B1

(12) United States Patent
Jenkins

(10) Patent No.: US 8,967,159 B1
(45) Date of Patent: Mar. 3, 2015

(54) HAIR STYLING IRON

(71) Applicant: Nyrisha Jenkins, Plainfield, NJ (US)

(72) Inventor: Nyrisha Jenkins, Plainfield, NJ (US)

( * ) Notice: Subject to any disclaimer, the term of this patent is extended or adjusted under 35 U.S.C. 154(b) by 0 days.

(21) Appl. No.: 13/969,564

(22) Filed: Aug. 17, 2013

Related U.S. Application Data

(60) Provisional application No. 61/742,702, filed on Aug. 17, 2012.

(51) Int. Cl.

| | |
|---|---|
| ***A45D 1/00*** | (2006.01) |
| ***A45D 2/00*** | (2006.01) |
| ***A45D 1/04*** | (2006.01) |
| ***A45D 2/40*** | (2006.01) |

(52) U.S. Cl.
CPC *A45D 2/001* (2013.01); *A45D 1/04* (2013.01); *A45D 2/40* (2013.01); *A45D 2/002* (2013.01)
USPC ..... 132/224; 132/223; 132/269; 219/225

(58) Field of Classification Search
CPC ..... A45D 1/04; A45D 1/06; A45D 1/02; A45D 1/14; A45D 1/18; A45D 2/001; A45D 2/002; A45D 2/36; A45D 2/40; A45D 2/42; A45D 4/06; A45D 4/12
USPC ..... 132/224, 211, 212, 223, 225–235, 268, 132/269, 127, 129; 34/96, 283; 392/379; 219/222, 223, 225, 226, 227–230
See application file for complete search history.

(56) References Cited

U.S. PATENT DOCUMENTS

| | | | | |
|---|---|---|---|---|
| 846,183 | A | 3/1907 | Call | |
| 1,455,696 | A * | 5/1923 | Wright | 132/224 |
| 1,486,786 | A * | 3/1924 | Morenilla | 132/224 |
| 1,609,156 | A * | 11/1926 | Conry | 132/224 |
| 1,611,580 | A * | 12/1926 | Chamberlain | 132/225 |
| 1,642,888 | A | 9/1927 | Perry | |
| 1,684,648 | A * | 9/1928 | Tingberg | 132/224 |
| 1,691,895 | A * | 11/1928 | Martin | 132/224 |
| 1,731,522 | A * | 10/1929 | Carlson | 132/224 |
| 1,847,479 | A * | 3/1932 | Godefroy | 132/224 |
| 1,865,655 | A * | 7/1932 | Walsh | 132/224 |
| 2,126,253 | A | 8/1938 | Goldberg | |
| 3,065,759 | A | 11/1962 | Lewis | |
| 3,516,420 | A * | 6/1970 | Porter | 132/263 |
| 4,139,014 | A | 2/1979 | Rowland | |
| 4,870,250 | A | 9/1989 | Rizzuto et al. | |
| 5,223,694 | A | 6/1993 | Tsuji et al. | |
| 5,357,988 | A * | 10/1994 | Nakamura | 132/232 |
| 5,785,064 | A * | 7/1998 | Simpson | 132/226 |
| 5,941,253 | A * | 8/1999 | Kaizuka | 132/232 |
| 5,957,140 | A * | 9/1999 | McGee | 132/224 |

(Continued)

*Primary Examiner* — Vanitha Elgart

(57) ABSTRACT

A hair styling iron. There is: a joint; a power module; an on/off switch and a temperature adjustment switch disposed on the joint and coupled to the power module. A first arm is coupled to the joint, including: a first handle extending from the joint; and a first heating iron extending in an arc from the joint. A second arm is coupled to the joint, including: a second handle with a plurality of finger grooves extending from the joint below the first handle; and a second heating iron with a heat indicator extending in an arc from the joint. A temperature sensor activates a light when said sensor detects heat above a threshold temperature. The temperature switch permits selectable temperature settings of the heating irons up to about 450 degrees Fahrenheit. The heating irons each include an interior, arcuate, heating plate that is matched to each other.

5 Claims, 5 Drawing Sheets

(56) References Cited

U.S. PATENT DOCUMENTS

| | | | | |
|---|---|---|---|---|
| 6,070,596 | A | 6/2000 | Altamore | |
| 6,173,718 | B1 * | 1/2001 | Okumoto et al. | 132/224 |
| 6,223,753 | B1 | 5/2001 | Lo | |
| 6,313,439 | B1 * | 11/2001 | Fischbach et al. | 219/223 |
| 6,647,990 | B2 * | 11/2003 | Shinn | 132/224 |
| 7,243,661 | B2 | 7/2007 | Lun et al. | |
| 7,341,064 | B2 | 3/2008 | Hebibi | |
| 7,931,031 | B2 | 4/2011 | LeGrain | |
| 8,091,563 | B2 | 1/2012 | Shepherd et al. | |
| 8,707,969 | B2 * | 4/2014 | Seng et al. | 132/211 |
| 2004/0187884 | A1 * | 9/2004 | Cook | 132/224 |
| 2005/0011533 | A1 * | 1/2005 | Ruben | 132/230 |
| 2005/0087205 | A1 | 4/2005 | Rizzuto, Jr. | |
| 2005/0098192 | A1 | 5/2005 | Cafaro | |
| 2005/0150511 | A1 * | 7/2005 | Park | 132/224 |
| 2006/0124625 | A1 | 6/2006 | Keig et al. | |
| 2006/0137705 | A1 * | 6/2006 | Barrett | 132/224 |
| 2006/0191554 | A1 * | 8/2006 | Lafuente | 132/224 |
| 2006/0191888 | A1 * | 8/2006 | Carlucci | 219/225 |
| 2006/0201527 | A1 | 9/2006 | Higgins et al. | |
| 2007/0251539 | A1 * | 11/2007 | Tackett et al. | 132/224 |
| 2009/0044823 | A1 * | 2/2009 | Overend et al. | 132/211 |
| 2009/0114240 | A1 * | 5/2009 | Leung | 132/224 |
| 2009/0126751 | A1 * | 5/2009 | Barrett | 132/122 |
| 2010/0101598 | A1 * | 4/2010 | Ng et al. | 132/223 |
| 2010/0180910 | A1 | 7/2010 | Hsu | |
| 2010/0206321 | A1 | 8/2010 | Takehana | |
| 2011/0079237 | A1 * | 4/2011 | Price | 132/224 |
| 2011/0132391 | A1 | 6/2011 | Cheung | |
| 2011/0162672 | A1 | 7/2011 | Liebenthal et al. | |
| 2011/0259356 | A1 | 10/2011 | Barton et al. | |
| 2012/0211018 | A1 | 8/2012 | deGrood | |
| 2012/0272993 | A1 | 11/2012 | Fereyre et al. | |
| 2012/0272994 | A1 | 11/2012 | Sayers et al. | |
| 2012/0291797 | A1 * | 11/2012 | deGrood et al. | 132/211 |
| 2012/0312319 | A1 | 12/2012 | Uwano | |
| 2012/0312320 | A1 | 12/2012 | Humphreys et al. | |
| 2013/0276813 | A1 * | 10/2013 | Barrett | 132/232 |
| 2014/0137887 | A1 * | 5/2014 | Cocks et al. | 132/224 |

* cited by examiner

HAIR STYLING IRON

CROSS-REFERENCE TO RELATED APPLICATIONS

This invention claims priority, under 35 U.S.C. §120, to the U.S. Provisional Patent Application No. 60/796,091 to Nyrisha Jenkins filed on Aug. 17, 2012, which is incorporated by reference herein in its entirety.

BACKGROUND OF THE INVENTION

1. Field of the Invention

The present invention relates to hair styling devices and mechanisms, specifically a hair styling iron that conveniently treats hair and provides ergonomic comfort to the hair styler.

2. Description of the Related Art

Various known hair styling irons or the like have heated, flat plates. Certain flat irons have non-flat heated surfaces comprising one or more of raised contours, grooves, pins, and channels. While each has a specialized purpose, such as shaping hair in a particular way, or detangling hair, none provide optimal performance for simultaneously straightening hair, detangling hair, and delivering maximum heat transfer. For example, designs that have mere pins or bristle-like protrusions effectively comb through hair, and in some instances detangle the hair, yet the pins are poor heat conductors and, therefore, do little to transfer heat. The result is that heat transfer is almost entirely limited to the surfaces of the flat iron surfaces that directly contact the hair. Furthermore, pins, particularly if a relatively large number are employed, have a tendency to get stuck in tangled hair and are difficult to pull through, particularly without causing discomfort. If it is not sufficiently hot, the curling or straightening effect is insufficient. If the iron is too hot, hair to which the iron is applied can be burnt or otherwise damaged. Furthermore, human hair comes in different thicknesses. What may be the appropriate temperature for curling or straightening thin hair may be insufficient to have any curling or straightening effect on thick hair. Similarly, what may be the appropriate temperature to curl or straighten thick hair, may be too hot and thus burn or otherwise damage thin hair. Thus, there is a need for a hair styling device which includes a relatively accurate temperature indication for the curling iron heated surface itself to enable selection of the appropriate temperature for human hair in general and for the thickness of the specific human hair to be curled or straightened in particular.

A drawback of conventional straightening irons is that they typically include a pair of arms which are pivotally joined or hinged at or near one common end, and are spring-loaded to the open position. In that respect, they resemble cooking tongs. Thus, a user must grip the two arms at the pivot end and exert a force to close the arms about the hair to be straightened.

Further professional hair stylists employing conventional hair styling devices working for long periods, the force they must apply to both grip the arms and exert the requisite clamping force can be fatiguing, especially after working for long periods of time. Also, since the arms are pivoted at the far end of the unit opposite the heated end, it is often difficult to properly control the iron to obtain the desired results. What is needed is a hair styling iron that provides ergonomical benefits to the hair stylist. Pain in the wrist or hand and loss of grip strength are symptoms of carpal tunnel syndrome which typically affect hair stylists that use conventional hair styling devices.

Some improvements have been made in the field. The following are non-limiting examples stated using their own words. The supporting teachings of which are incorporated herein by reference.

U.S. Pat. No. 1,642,888, issued to M. L. Perry, discloses a hair straightening device for treating and straightening curly and kinky hair.

U.S. Pat. No. 3,065,759, issued to Lewis, discloses a new type of electrical heated hair straightener, and one of its objects is to provide a hair straightener tool or device with a comb and a hair heating unit located in line with the hair receiving slots of the comb, which will penetrate the combed hair and exert a zig-zag action on the hair, which will apply considerable pressure to the hair and considerable friction and transmit heat into the mass of the hair passed through the comb, so that a quick and durable hair straightening action is obtained in a short period of time.

U.S. Pat. No. 7,243,661, issued to Lun et al., discloses a hair styling device which includes two blades that are hinged together at one thereof and provide heated plates at the opposite ends for styling hair. The blades and heated plates provide a fine straight edge at one side and a rounded edge at the opposing side.

U.S. Patent Application No. 2005/0098192, issued to Cafaro, discloses an appliance, in particular a hair styling appliance, having a programmable electronic control that controls operational features of the appliance and where the appliance is equipped with a display screen that provides a visual indication of the status of the operational features on the display.

U.S. Patent Application No. 2006/0124625 issued to Keig et al., discloses a hair treatment device comprising a base having a means for collection to an electrical power supply, the base including a socket including a first electrical connector, tongs comprising a pair of limbs including at least one resistive of heating element, the limbs being connected by a hinge, the tongs further comprising a socket engaging portion including a second electrical connector, the socket engaging portion being adapted to releasably engage the socket so that the first electrical connector connects to the second electrical connector to connect the resistive element to the power supply, wherein the limbs are arranged to extend upwardly when engaged to the base.

U.S. Patent Application No. 2006/0201527, issued to Higgins et al., discloses a multifunction hair styling appliance which includes a base unit having at least one styling attachment, wherein the at least one styling attachment is detachably and electrically connected to the base unit and is capable of styling hair.

U.S. Patent Application No. 2011/0162672, issued to Liebenthal et al., discloses a hair styling device that can be used for curling and straightening hair. Particularly, the invention relates to a hair styling device having a first styling part and a second styling part, such that these two styling parts are movable in relation to one another and hair can be placed between the two styling parts, at least one styling part having a hair guidance part and also having a grip part that is structurally different from the hair guidance part, wherein the hair guidance part has a row of convexities and concavities and grip part has a row of convexities and concavities, and the hair guidance part and the grip part have a shared base area.

The inventions heretofore known suffer from a number of disadvantages which include one or more of: causing fatigue, wrist tension, sore hands, etc. to the hair stylist; difficult to control; heats up to a limited upper temperature range which is not suitable for individuals with very rough or course hair; and/or limited in applicability.

What is needed is a hair styling iron that solves one or more of the problems described herein and/or one or more problems that may come to the attention of one skilled in the art upon becoming familiar with this specification.

SUMMARY OF THE INVENTION

The present invention has been developed in response to the present state of the art, and in particular, in response to the problems and needs in the art that have not yet been fully solved by currently hair treatment devices and the like. Accordingly, the present invention has been developed to provide a hair styling iron for treating hair and providing ergonomical benefits to the hair stylist.

According to one embodiment of the present invention, the hair styling iron includes: a joint that may include a power module; an on/off switch that may be functionally coupled to the power module; a temperature adjustment switch that may be functionally coupled to the power module; and/or a first arm that may be coupled to the joint about a middle region of the first aim. The first arm may include: a first handle extending from the joint; and/or a first heating iron extending in an arc from the joint opposite the first handle.

In another embodiment of the present invention, there may be a second arm coupled to the joint about a middle region of the second aim, including: a second handle that may extend from the joint below the first handle, wherein the second handle may include plurality of finger grooves on an underside thereof; and/or and a second heating iron extending in an arc from the joint above the first heating iron. The second heating iron may include a heat indicator.

In yet another embodiment of the present invention, the on/off switch may be disposed on a lateral side of the joint and/or the temperature adjustment switch may be disposed on a side opposite the on/off switch.

In even yet another embodiment of the present invention, the temperature adjustment switch and power module may be together and/or maybe configured to permit selectable temperature settings of the first heating iron and/or second heating iron to have an upper range of at least about 450 degrees Fahrenheit.

In still yet another embodiment of the present invention, the first heating iron and/or second heating iron may each include an interior heating plate that may be arcuate and/or matched one to another.

Further, one embodiment of the present invention may include the heat indicator having a temperature sensor that may be functionally coupled to a light, such that when the temperature sensor detects heat above a threshold temperature the light may be activated.

Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize that the invention can be practiced without one or more of the specific features or advantages of a particular embodiment. In other instances, additional features and advantages may be recognized in certain embodiments that may not be present in all embodiments of the invention.

These features and advantages of the present invention will become more fully apparent from the following description and appended claims, or may be learned by the practice of the invention as set forth hereinafter.

BRIEF DESCRIPTION OF THE DRAWINGS

In order for the advantages of the invention to be readily understood, a more particular description of the invention briefly described above will be rendered by reference to specific embodiments that are illustrated in the appended drawing(s). Understanding that these drawing(s) depict only typical embodiments of the invention and are not therefore to be considered to be limiting of its scope, the invention will be described and explained with additional specificity and detail through the use of the accompanying drawing(s), in which.

DETAILED DESCRIPTION OF THE INVENTION

Figure 1:
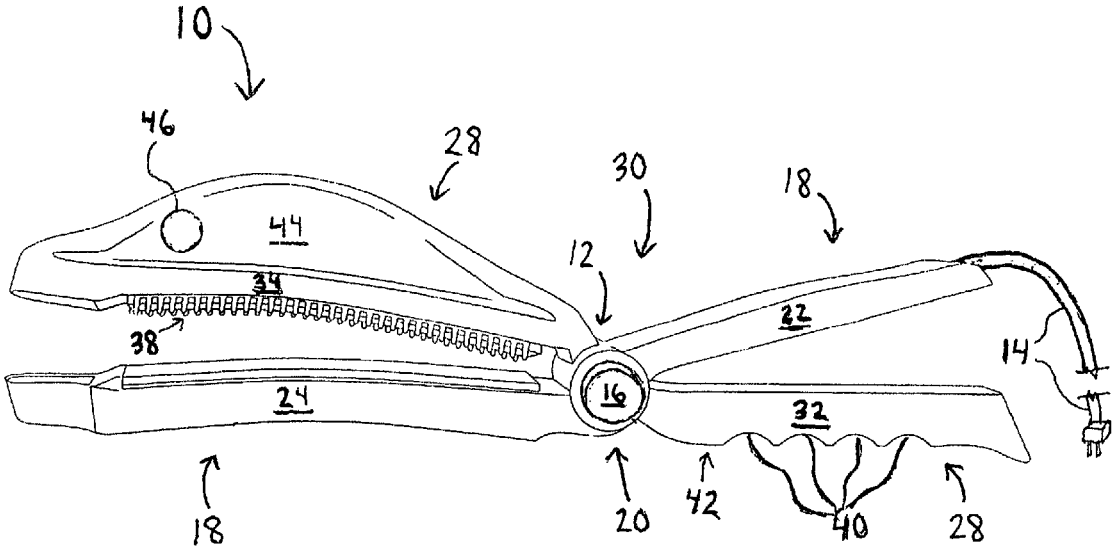
FIG. 1 is a side perspective view of a hair styling iron, according to one embodiment of the invention.

For the purposes of promoting an understanding of the principles of the invention, reference will now be made to the exemplary embodiments illustrated in the drawing(s), and specific language will be used to describe the same. It will nevertheless be understood that no limitation of the scope of the invention is thereby intended. Any alterations and further modifications of the inventive features illustrated herein, and any additional applications of the principles of the invention as illustrated herein, which would occur to one skilled in the relevant art and having possession of this disclosure, are to be considered within the scope of the invention.

Reference throughout this specification to "one embodiment," "an embodiment," or similar language means that a particular feature, head member, or characteristic described in connection with the embodiment is included in at least one embodiment of the present invention. Thus, appearances of the phrases "one embodiment," "an embodiment," and similar language throughout this specification may, but do not necessarily, all refer to the same embodiment, different embodiments, or component parts of the same or different illustrated invention. Additionally, reference to the wording "an embodiment," or the like, for two or more features, elements, etc. does not mean that the features are related, dissimilar, the same, etc. The use of the term "an embodiment,"

or similar wording, is merely a convenient phrase to indicate optional features, which may or may not be part of the invention as claimed.

Each statement of an embodiment is to be considered independent of any other statement of an embodiment despite any use of similar or identical language characterizing each embodiment. Therefore, where one embodiment is identified as "another embodiment," the identified embodiment is independent of any other embodiments characterized by the language "another embodiment." The independent embodiments are considered to be able to be combined in whole or in part one with another as the claims and/or art may direct, either directly or indirectly, implicitly or explicitly.

Finally, the fact that the wording "an embodiment," or the like, does not appear at the beginning of every sentence in the specification, such as is the practice of some practitioners, is merely a convenience for the reader's clarity. However, it is the intention of this application to incorporate by reference the phrasing "an embodiment," and the like, at the beginning of every sentence herein where logically possible and appropriate.

As used herein, "comprising," "including," "containing," "is," "are," "characterized by," and grammatical equivalents thereof are inclusive or open-ended terms that do not exclude additional unrecited elements or method steps. "Comprising" is to be interpreted as including the more restrictive terms "consisting of" and "consisting essentially of."

It is understood that the above-described embodiments are only illustrative of the application of the principles of the present invention. The present invention may be embodied in other specific forms without departing from its spirit or essential characteristics. The described embodiment is to be considered in all respects only as illustrative and not restrictive. The scope of the invention is, therefore, indicated by the appended claims rather than by the foregoing description. All changes which come within the meaning and range of equivalency of the claims are to be embraced within their scope.

FIG. 1 is a side perspective view of a hair styling iron, according to one embodiment of the present invention. As shown, the hair styling iron includes: a joint 12; a power module 14; a temperature adjustment switch 16 functionally coupled to the power module 14; a first arm 18 coupled to the joint 12 about a middle region 20 of the first arm 18. The first arm 18 includes: a first handle 22 extending from the joint 12; and a first heating iron 24 extending in an arc 26 (See FIG. 5) from the joint 12 opposite the first handle 22.

According to one embodiment of the hair styling iron 10 as shown in FIG. 1, the hair styling iron 10 further includes a second arm 28 coupled to the joint 12 about a middle region 30 of the second arm 28. The second arm 28 includes: a second handle 32 extending from the joint below the first handle 22; and a second heating iron 34 extending in an arc 36 (See FIG. 5) from joint 12 above the first heating iron 24. The second arm 28 includes a comb attachment 38 coupled that is configured to detangle very curly and coarse hair. The joint 12 serves as a pivot point about the middle regions 20, 30 of the arms 18, 28 such that the arms are rotatably coupled to each other. This enables a user to compress the handles 22, 32 together causing the heating irons 24, 34 to press together such that hair can be treated.

In the illustrated embodiment, the second handle 32 includes a plurality of finger grooves 40 on a underside 42 thereof. The finger grooves 40 serve as a resting place for a user's fingers thus providing extended comfort to the user's hands while controlling the opening and closing of the heating irons 24, 34.

The illustrated second heating iron 34 includes a head member 44 coupled thereon and protruding upward orthogonally therefrom in a bulging manner. There is a heat indicator 46 disposed on the curved head member 44 that is configured to alert the user that the hair styling iron 10 is activated, ready for employment and hot.

Figure 2:
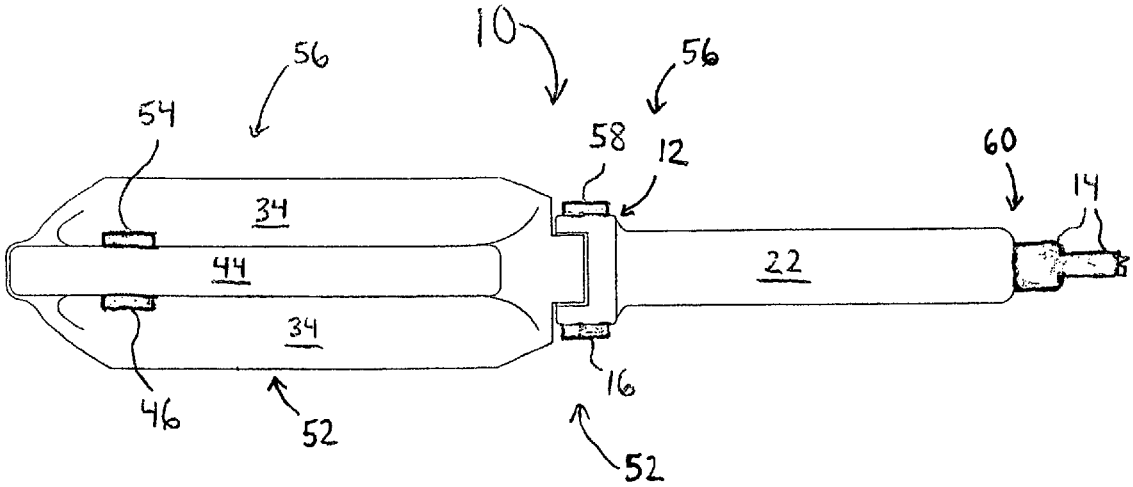
FIG. 2 is a top plan view of a hair styling iron, according to one embodiment of the invention.

FIG. 2 illustrates a top plan view of the hair styling iron 10 for treating hair according one embodiment of the present invention. As shown, the heat indicator 46 is disposed on a left lateral side 52 of the head member 44, and a power light 54 disposed on a right lateral side 56 of the head member 44 and diametrically opposite the heat indicator 46. Additionally, the temperature adjustment switch 16, such as but not limited to a temperature control switch sold by A & R Supply Company, 2700 Broadbent Parkway Nebr., Suite C. Albuquerque, N. Mex. 87107, is disposed on the left lateral side 52 of the joint 12. An on/off switch 58 is disposed on the right lateral side 56 of the joint 12 and diametrically opposite the temperature adjustment switch 16.

The illustrated heat indicator 46 is configured to alert the user that the heating irons 24, 34 are hot. The power light 54, such as a light emitting diode (LED), is configured to alert the user that the hair styling iron 10 is activated and ready for employment. The position of the heat indicator 46 and power light 54 on the head member 44 gives an appearance of "eyes" on an animal and inherently instruct the user that the device is not ready until both "eyes" are solidly illuminated. The illustrated power module 14 is a conventional power cable that is adapted to be plugged into a standard 120V electrical power outlet as one skilled in the art would understand, and is coupled to an end 60 of the first handle 22.

Figure 3:
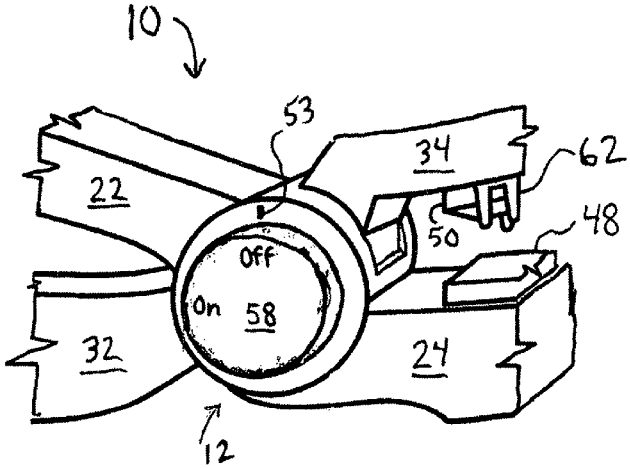
FIG. 3 is a side perspective view of a hair styling iron, showing a joint, according to one embodiment of the invention.

FIG. 3 is a side perspective view of a hair styling iron, showing a joint, according to one embodiment of the invention. As shown, the on/off switch 58 is disposed on the right lateral side 56 of the joint 12 and configured to activate and deactivate the power module 14, when turned on and off as desired by a hair stylist. One limiting example of the on/off switch 58 is a miniature rotary switch supplied by NKK Switches, Inc., 7850 E. Gelding Drive, Scottsdale, Ariz. 85260.

Figure 4:
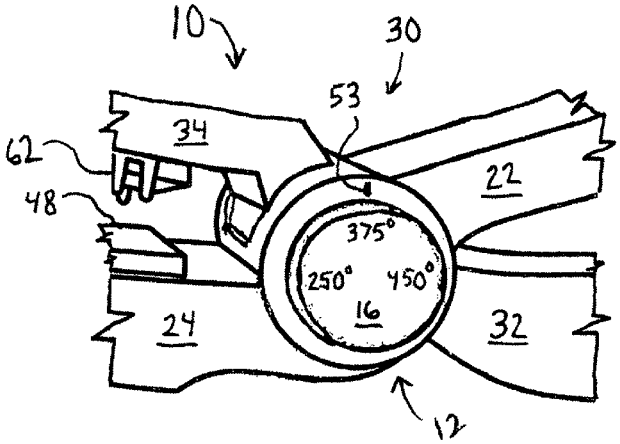
FIG. 4 is a side perspective view of a hair styling iron, showing a joint, according to one embodiment of the invention.

FIG. 4 is a side perspective view of a hair styling iron, showing a joint, according to one embodiment of the invention. As shown, the temperature adjustment switch 16 is disposed on the left lateral side 52 of the joint 12 and configured to permit user-selectable temperature settings of the heating irons 24, 34 to have an upper temperature range of at least about 450 degrees Fahrenheit. In operation, the user would align the illustrated temperature adjustment switch 16, such as a thermostat dial pointer for example, with the indicator 53 on the joint casing to a desired temperature setting such as "275 degrees Fahrenheit," "375 degrees Fahrenheit" or "450 degrees Fahrenheit" corresponding to a specific hair quality, hair condition or hair procedure. One skilled in the art could envision that the temperature adjustment switch 16 could display different and/or more temperature settings, wherein said temperature settings of the heating irons 24, 34 could have upper temperature range higher than 450 degrees Fahrenheit, such as 500 degrees Fahrenheit for a non-limiting example, to treat individuals having extremely coarse or curly hair, without causing damage to the hair.

Figure 5:
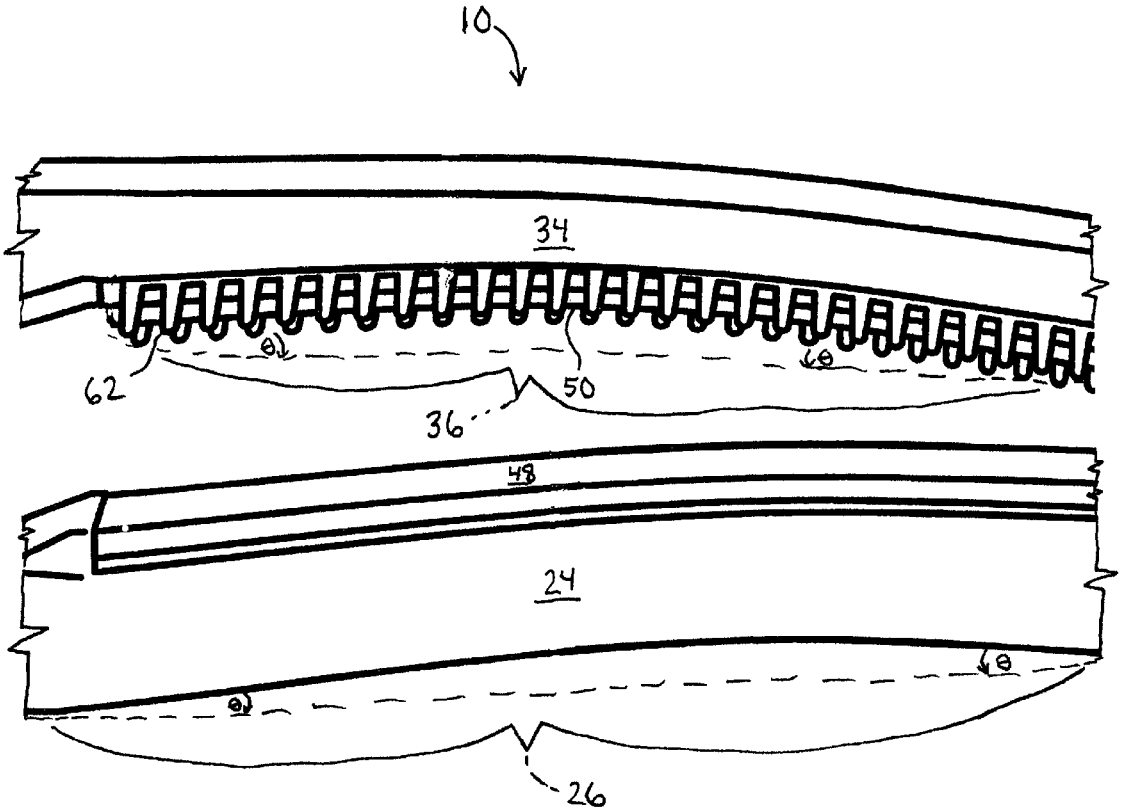
FIG. 5 is a side perspective view of a hair styling iron, showing a pair of heating irons, according to one embodiment of the invention.

FIG. 5 is a side perspective view of a hair styling iron, showing a pair of heating irons, according to one embodiment of the invention. As illustrated, there is a first interior heating plate 48 coupled to the first heating iron 24 and a second interior heating plate 50 coupled to the second heating iron 34. The interior heating plates 48, 50 maybe comprised of thermally conductive and electrically insulating material, such as, but not limited to Ceramic Tourmaline, such that as that sold by Misikko, Inc., 3920 N. providence Road, Newtown Square, Pa. 19073, for example. When the heating plates 48, 50 are energized by the power module 14, said heating plates generally receive heat by convection or conduction from an internal heating coil housed in the heating irons 24, 34. When the heating plates 48, 50 heat up beyond a minimum operating threshold temperature, it is believed that the plates 48, 50 are configured emit far infra-red heat to help return moisture to hair; neutralize the positive ions in damaged, rough or coarse hair; and generate negative ions that makes hair smoother, straighter, and/or have a shinier appearance.

In the illustrated embodiment, the heating plates 48, 50 are arcuate and their respective arcs 26, 36 are matched one to the other, such that the heating irons 24, 34 mate when pressed together. Advantageously, this enables more volume is added to the human hair, thus eliminating the possibility of a hair professional experiencing wrist tension when gripping the handles 22, 32 together. This also enables hair to be treated without undue force being applied to the user's hands or wrists, preventing the onset of fatigue, discomfort, or carpal tunnel syndrome. Further, the illustrated embodiment provides heat to help return moisture to the hair, and it helps ensure hair looks shinier and healthier.

In the illustrated embodiment, the first interior heating plate 48 is coupled to the first heating iron 24 and the comb attachment 38. The second interior heating plate 50 is coupled to the second heating iron 34. As shown, the comb attachment 38 has a plurality of teeth 62 coupled thereto. The teeth 62 on the comb attachment 38 and the heating plates 48, 50 cooperate together to detangle hair when heat is transferred by conduction and convection from the heating irons 24, 34 to the heating plates 48, 50, resulting in the heating plates 48, 50 being hot.

Figure 6:
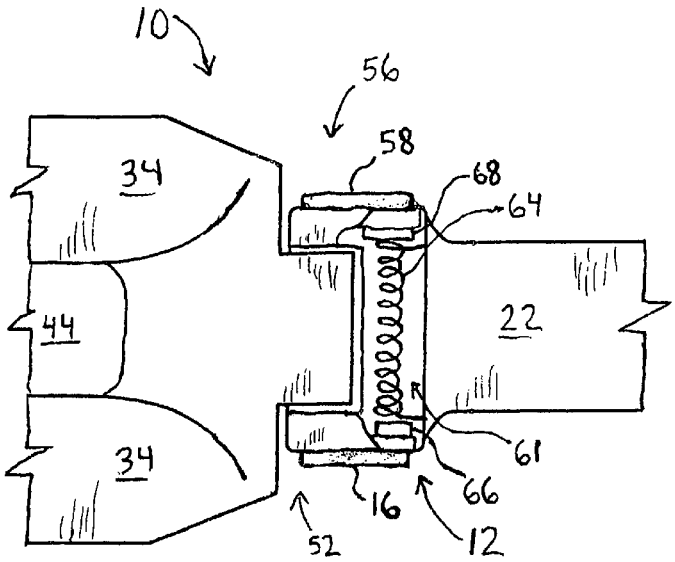
FIG. 6 is a partial cross-sectional top plan view of a hair styling iron, showing a joint, according to one embodiment of the invention.

FIG. 6 is a partial cross-sectional top plan view of a hair styling iron, showing a joint, according to one embodiment of the invention. As illustrated, the surface of the joint 12 is cut-away to expose in an interior 61 of said joint 12. As illustrated in the interior 61 of the joint 12, a spring 64 (bias member) is disposed inside of the joint 12 between the temperature adjustment switch 16 and on/off switch 58. The spring 64 is bounded by a first wall 66 and a second wall 68, wherein said walls 66, 68 are configured to hold the spring in place. The spring 64 may be coupled to the arms 18, 28 and thereby produce a bias in said arms 18, 28 to a particular rotational position, such as but not limited to biasing the heating plates 48, 50 to be pressed together. Additionally, the temperature adjustment switch 16 is disposed on the left lateral side 52 of the joint 12 and an on/off switch 58 is disposed on the right lateral side 56 of the joint 12 and diametrically opposite the temperature adjustment switch 16.

Figure 7:
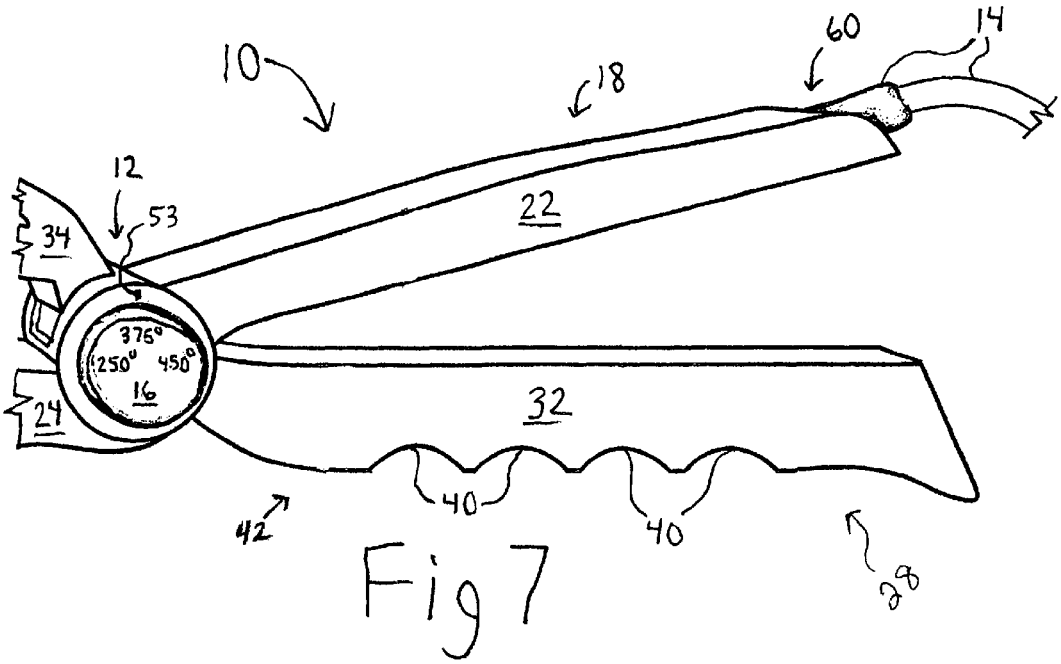
FIG. 7 is a side perspective view of a hair styling iron, showing a pair of handles, according to one embodiment of the invention.

FIG. 7 is a partial side view of a hair styling iron 10, according to one embodiment of the invention. As illustrated, the finger grooves 40 on the underside of the first handle 22 are configured to receive human fingers. The retractable handles 22, 32 and finger grooves 40 cooperate together to provide comfort to hair stylists while controlling the opening and closing of the arms 18, 28 when the handles are being gripped and manipulated during the process of treating hair. One skilled in the art could understand that the finger grooves 40 are adapted to receive fingers of various sizes.

As illustrated, the spring 64 and walls 66, 68 inside of the joint 12 cooperate together to enable the handles 22, 32 to be spring-loaded (See FIG. 6) which allows the hair stylists to grip the handles 22, 32 and bring said handles 22, 32 together, thus opening the interior heating plates 48, 50.

Figure 8:
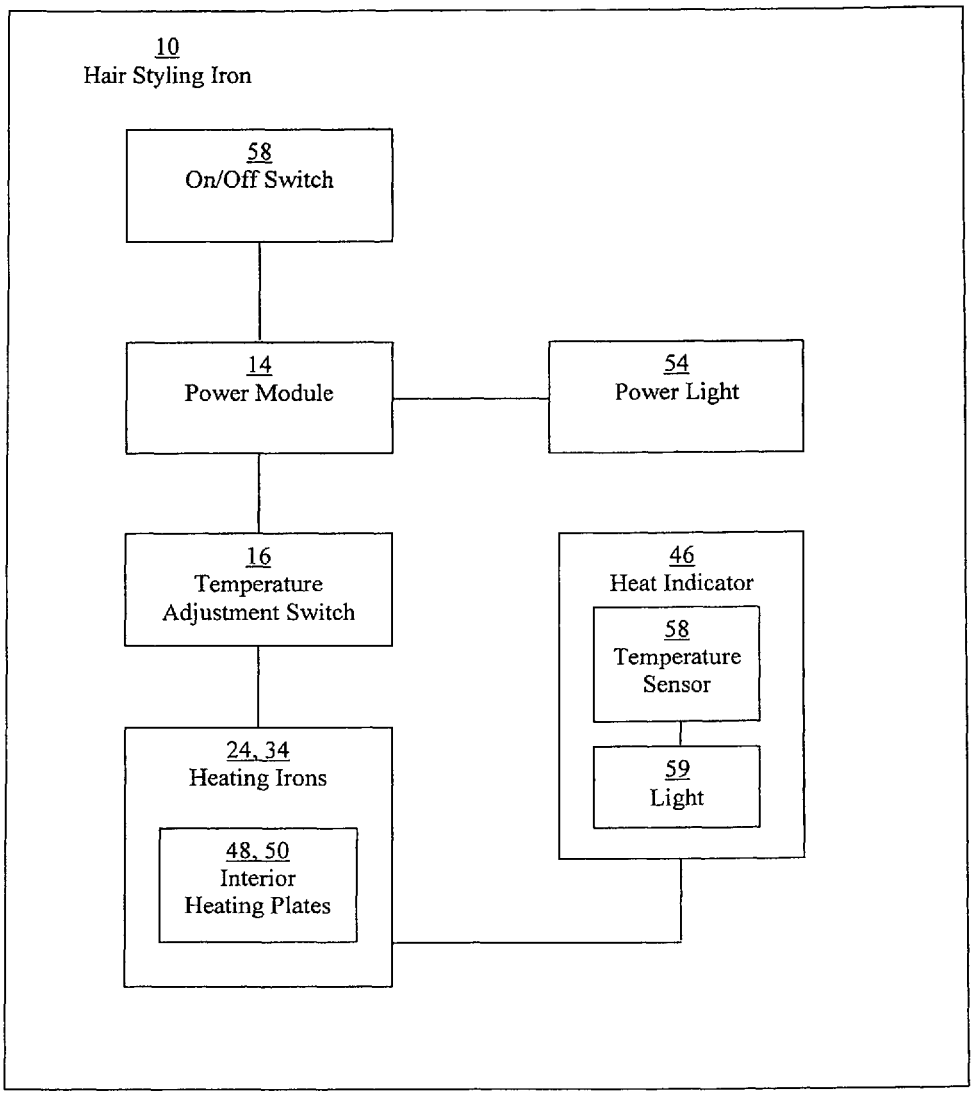
FIG. 8 is a block diagram of a hair styling iron, according to one embodiment of the invention.

FIG. 8 illustrates a block diagram of the hair styling iron 10 according one embodiment of the present invention. As shown, the power module 14 is in electrical communication with each of the temperature adjustment switch 16, power light 54 and on/off switch 58. In operation, when a user turns the on/off switch 58, such as but not limited to a two-position rotary switch known in the art, the power light 54 (one "eye") is activated and illuminates in a solid manner to alert the user that the hair styling iron 10 is powered on. The power module 14 and temperature adjustment switch 16 cooperate together to permit user-selectable temperature settings of the heating irons 24, 34 to have an upper range of at least about 450 degrees Fahrenheit. A non-limiting example of the temperature adjustment switch 16 is a temperature control switch that is sold by A & R Supply Company, 2700 Broadbent Parkway Nebr., Suite C, Albuquerque, N. Mex. 87107.

The illustrated temperature adjustment switch 16 is functionally coupled to the heat indicator 46 which includes a temperature sensor 58, such as a temperature sensing circuit, in which one skilled in the art would know may comprise a integrated circuit, thermocouple, thermistor or temperature sensing diode to respond to the temperature of interior heating plates as controlled by the temperature adjustment switch 16. One non-limiting example of a temperature sensor 58 is a passive infrared temperature sensor as sold by Texas Instruments, Inc., 12500 TI Boulevard, Dallas, Tex. 75243.

As illustrated, the temperature sensor 58 is functionally coupled to the heat indicator 46 and heat indicator light 59 that when the temperature sensor 58 detects heat above a minimum operating threshold temperature the heat indicator 46 and heat indicator light 59 are activated. The heat indicator light 59 is in the interior of the heat indicator 46 and is configured to blink and/or display a solid light when the temperature sensor 58 senses when the temperature of the heating plates 48, 50 is at either below and/or above a minimum operating threshold temperature. A non-limiting example of the heat indicator light 59 is a light emitting diode (LED) that may be configured to blink until the heating plates 48, 50 reach a minimum operating temperature threshold. Once said temperature threshold is reached, the heat indicator 46 (other "eye") would instruct the heat indicator light 59 to display a solid light that alerts hair stylists that the hair styling iron 10 is powered on, hot, and ready to employ.

In other embodiments of the present invention, the power module 14, such as a 9-volt battery or the like, may be present and be configured to be removably coupled to the at least one of the heating irons 24, 34 or the head member 44, thereby enabling hair stylists to employ the hair styling iron 10 as a wireless device to provide more freedom of movement and convenience while treating hair without departing from scope of the invention.

In operation of the illustrated embodiments, when hair stylists are preparing to treat hair, they can turn the on/off switch 58 to the "On" position which will enable the power module 14 to provide power to the heating irons 24, 34, thus energizing the interior heating plates 48, 50. This will also activate the power light 54, thus illuminating one of the "eyes" on the head member 44. Hair stylists then can align the temperature adjustment switch 16 to a setting such as but not limited to a "275 degrees Fahrenheit," "375 degrees Fahrenheit" or "450 degrees Fahrenheit" or similar temperature setting corresponding to a specific hair quality, hair condition or hair procedure. Once the interior heating plates 48, 50 heat up to a minimum operating threshold temperature, such as but not limited to a temperature selected by the temperature adjustment switch 16, the temperature sensor 58 will detect the temperature and trigger the heat indicator 46 (other "eye")

46 to illuminate the heat indicator light 59 when said threshold temperature is reached, thereby alerting the hair stylists that the hair styling iron 10 is activated, hot and ready to be employed for the treatment of human hair.

Additionally, in operation of the illustrated embodiment of the hair styling iron 10, when hair stylists desire to bend, manipulate, or otherwise treat hair, hairstylists will place their fingers in the finger grooves 40 on the underside 42 of the first handle 22 and the palm of their hands on the second handle 32 to grip and comfortably control and close the arms 18, 28 about the joint 12, causing the arcuate interior heating plates 48, 50 that are coupled to the heating irons 24, 24 to engage and transfer heat, according to the user-selectable temperature settings as shown and described in FIG. 4, to the roots of the hair. Hair stylists can then comfortably manipulate the comb attachment 38, enabling the teeth 62 coupled thereto to grab and detangle curly or coarse hair as the interior heating plates 48, 50 are locked and slide down from the root to the end of the sectioned hair for example. This allows hair stylists to bend hair according to the desires of the individual being treated without suffering from wrist tension, hand fatigue, carpal tunnel, and other forms of bodily discomfort, especially when treating hair for extended periods of time at the hair salon. The retractable handles 22, 32 and the finger grooves 40 cooperate together to allow the hair stylists' fingers to comfortably control the hair styling iron 10. After treating hair stylists can turn the on/off switch 58 to the "Off" position instructing the power module 14 to deactivate the hair styling iron 10. Once the hair styling iron 10 is deactivated, the power light 54 (one "eye") will shut off while heat indictor 46 (other "eye") will instruct the heat indicator light 59 to remain solidly lit until the temperature sensor 58 senses that the temperature of the heating plates 48, 50 is cooled to a temperature below the minimum operating threshold temperature. Then the heat indicator light 59 will be deactivated and shut off.

Embodiments of the hair styling iron 10 fulfill a need for a hair styling device or the like that enables human hair to be groomed and treated while provide ergonomical benefits to hair professionals, such as eliminating wrist tension when the hair stylist uses a hair styling device to bend an individual's hair from the roots to the ends into the desired hair style. The employment of the present significantly reduces the risk of hair stylist suffering from hand fatigue, sore hands, carpal tunnel, etc.

It is envisioned that one skilled in the art would understand that the joint 12; power module 14; temperature adjustment switch 16; arms 18, 28; handles 22, 32; arcs 26, 36; comb attachment 38; finger grooves 40; head member 44; heat indicator 46; heating plates 48, 50; light 54; on/off switch 58; teeth 62; spring 64; and walls 66, 68 can vary in shape, size and orientation unless specifically limited, according to various embodiments of the present invention.

Although FIG. 2 shows the temperature adjustment switch 16 and the light heat indicator 46 being disposed on the left lateral side 52 of the joint 12 and head member 44, and the light 54 and on/off switch 58 being disposed on the right lateral side 56 of the joint 12 and head member 44, one skilled in the art can envision that the light 54 and on/off switch can be disposed on the left lateral side 52 and the temperature adjustment switch 16 and heat indicator 46 can be disposed on the right lateral side 56, respectively, according to alternative embodiments of the invention.

More, one skilled in the art can envision that the interior heating plates 48, 50 may be comprised of other thermally conductive and electrically insulating material, such as silicon polymer, ceramics, crystal boron silicate mineral, and other synthetic materials according to other embodiments without departing from the spirit of the present invention.

Further, it is envisioned that the radius of curvature of the heating irons 24, 34; comb attachment 38; and interior heating plates 48, 50 as shown in FIG. 5 can vary while remaining matched to each other, according to various embodiments without departing from the spirit of the present invention.

It is further expected that there could be numerous variations of the design of this invention. An example is that the components of the hair styling iron 10 may vary in size, shape, design, color, texture, etc, according to various embodiments of the present invention.

Finally, it is envisioned that the components of the hair styling iron 10 may be constructed of a variety of materials, such as plastic, silicon polymer, metal, ceramic, rubber, etc. according to various embodiments of the present invention.

Thus, while the present invention has been fully described above with particularity and detail in connection with what is presently deemed to be the most practical and preferred embodiment of the invention, it will be apparent to those of ordinary skill in the art that numerous modifications, including, but not limited to, variations in size, materials, shape, form, function and manner of operation, assembly and use may be made, without departing from the principles and concepts of the invention as set forth in the claims.

What is claimed is:

1. A hair styling iron for treating hair comprising:

a first arm including a joint at a middle region of said arm, said first arm including:

a first handle extending from said joint and a first heating iron having a length extending upwardly in an arc continuously from said joint in a longitudinal direction opposite said first handle to an end of said first heating iron;

a second arm coupled to said joint at a middle region of said second arm, said second arm including:

a second handle extending from said joint below said first handle and including a plurality of finger grooves on an underside thereof and a second heating iron having a length extending upwardly in an arc continuously from said joint in a longitudinal direction opposite said second handle and above said first heating iron to an end of said second heating iron, said second heating iron including a heat indicator; and first and second heating plates extending along the length of said first and second heating irons, respectively, each of said heating plates being arcuate and complementary to each other.

2. The hair styling iron of claim 1 wherein said heat indicator includes a temperature sensor functionally coupled to a light such that when said temperature sensor detects heat above a threshold temperature said light is activated.

3. The hair styling iron of claim 1 wherein said second heating iron includes an arcuate comb attachment.

4. The hair styling iron of claim 1 wherein said joint includes a power module, an on-off switch, and a temperature adjustment switch, each of said switches being functionally coupled to said power module, said on/off switch being disposed on lateral side of said joint and said temperature adjustment switch being disposed opposite said on/off switch.

5. The hair styling iron of claim 4 wherein said temperature adjustment switch and said power module together permit selectable temperature settings of said first and second heating irons to have an upper range of at least about 450 degrees Fahrenheit.

* * * * *